US008059081B2

(12) United States Patent
Yasuda et al.

(10) Patent No.: US 8,059,081 B2
(45) Date of Patent: Nov. 15, 2011

(54) DISPLAY DEVICE

(75) Inventors: Kozo Yasuda, Mobara (JP); Katsumi Matsumoto, Mobara (JP); Toshio Miyazawa, Chiba (JP)

(73) Assignee: Hitachi Displays, Ltd., Chiba (JP)

( * ) Notice: Subject to any disclaimer, the term of this patent is extended or adjusted under 35 U.S.C. 154(b) by 820 days.

(21) Appl. No.: 11/682,903

(22) Filed: Mar. 7, 2007

(65) Prior Publication Data

US 2007/0211012 A1 Sep. 13, 2007

(30) Foreign Application Priority Data

Mar. 8, 2006 (JP) ..... 2006-061994

(51) Int. Cl.
*G09G 3/36* (2006.01)

(52) U.S. Cl. ..... 345/100

(58) Field of Classification Search ..... 345/87–104
See application file for complete search history.

(56) References Cited

U.S. PATENT DOCUMENTS 6,266,040 B1 * 7/2001 Nagatomo ..... 345/98
7,057,596 B2 6/2006 Miyazawa
2002/0135554 A1 * 9/2002 Yamazaki et al. ..... 345/92
2003/0076149 A1 * 4/2003 Haga ..... 327/333
2003/0214477 A1 * 11/2003 Murakami et al. ..... 345/100

FOREIGN PATENT DOCUMENTS

JP 2003-302946 10/2003

* cited by examiner

*Primary Examiner* — Amr Awad
*Assistant Examiner* — Kenneth Bukowski
(74) *Attorney, Agent, or Firm* — Antonelli, Terry, Stout & Kraus, LLP.

(57) ABSTRACT

In the display device which is used in a miniaturized portable equipment, when a drive circuit is also connected on the same substrate as pixels, an input signal of low voltage has a level thereof shifted even when the threshold value is large or fluctuated. The display device includes pixel electrodes, switching elements which supply video signals to the pixel electrodes, and a drive circuit which supplies the video signals to the switching elements on the same substrate, wherein the drive circuit includes a level shift circuit, the level shift circuit includes a transistor. In a state that the transistor assumes an ON state, when an input signal is inputted to a source terminal and the input signal is at a low voltage level, a drain terminal assumes a low voltage level. Further, even when the input signal is at a high voltage level equal to or lower than a threshold value, the drain terminal outputs a voltage equal to or more than the threshold value as a high level voltage.

10 Claims, 6 Drawing Sheets

DISPLAY DEVICE

The present application claims priority from Japanese application JP2006-061994 filed on Mar. 8, 2006, the content of which is hereby incorporated by reference into this application.

BACKGROUND OF THE INVENTION

1. Field of the Invention

The present invention relates to an active-matrix-type display device, and more particularly to a drive-circuit-integral type display device which forms a drive circuit on the same substrate as a display region.

2. Description of the Related Art

A TFT (Thin Film Transistor) type liquid crystal display device which includes a switching element in a pixel portion has been popularly used as a display device of a personal computer or the like. Further, the TFT-type display device is also used as a display device of a personal computer or the like. The display device used in the portable device is required to be further miniaturized and to exhibit the further reduction of power consumption compared to a conventional liquid crystal display device.

As the display device which possesses the structure effective for the miniaturization, there has been known a so-called drive-circuit integral type display device which also forms a drive circuit which supplies signals to a pixel portion.

In incorporating the circuit in the display device, there arises a drawback that a voltage level of an inner circuit and a voltage level of an input signal from an external device differ from each other. To overcome this drawback, a level shift circuit which converts a voltage level is used.

JP-A-2003-302946 describes a level shift circuit which is used in a drive-circuit integral type display device.

SUMMARY OF THE INVENTION

In the drive-circuit integral type display device, when the drive circuit is constituted of a poly-silicon transistor, the poly-silicon transistor exhibits a high threshold value and, further, irregularities of the threshold value are also large and hence, there has been a drawback that the drive circuit is not operated with a level shift circuit in a usual silicon transistor.

The present invention has been made to overcome the above-mentioned drawbacks of the related art and it is an object of the present invention to provide a technique which realizes an optimum drive circuit in a miniaturized display device.

The above-mentioned and other object and novel features of the present invention will become apparent based on the description of the specification and attached drawings.

To briefly explain the summary of typical inventions among the inventions which are disclosed in the present invention, they are as follows.

Pixel electrodes, switching elements which supply video signals to the pixel electrodes, and a drive circuit which supplies the video signals to the switching elements are formed on the same substrate, the drive circuit includes a level shift circuit, and the level shift circuit includes a transistor, wherein the transistor assumes an ON state so as to input an input signal to a source terminal and the input signal assumes a low voltage level, a drain terminal assumes a low voltage level, whereby even when the input signal assumes a high voltage level equal to or lower than a threshold value, a drain terminal outputs a voltage equal to or more than the threshold value as a high voltage level.

In a drive circuit in which a semiconductor layer is formed of poly-silicon, it is possible to use the input signal of a voltage lower than the threshold value of the transistor which constitutes a drive circuit.

In the display device having a display panel, pixel electrodes are formed on a display panel in a matrix array, wherein a switching element which supplies a video signal is provided to each pixel electrode. Further, on a display panel, video signal lines which supply video signals to switching elements, scanning signal lines which supply scanning signals for performing an ON/OFF control of the switching elements, and a drive circuit which supplies the video signals to the video signal lines are formed.

A transistor which constitutes a level shift circuit is provided to an input part of the display panel, and a resistance is connected to a drain terminal of the transistor to supply a voltage to the drain terminal through the resistance. Further, a voltage is supplied to a gate terminal of the transistor to bring the transistor into an ON state thus allowing the transistor to assume the ON state, and an input signal is inputted to a source terminal of the transistor.

With respect to the transistor in an ON state, when the input signal is at a low voltage level, a voltage drop is generated due to the resistance connected to the drain terminal attributed to a current which flows in the transistor to output a low-level voltage from the drain terminal. When the input signal of high voltage level is inputted to the source terminal, the voltage of the source terminal is elevated in response to the input signal, and the current which flows in the transistor is decreased to decrease the voltage drop so as to output a high-level voltage from the drain terminal.

DESCRIPTION OF THE PREFERRED EMBODIMENTS

Hereinafter, embodiments of the present invention are explained in detail in conjunction with drawings. In all drawings for explaining embodiments, parts having identical functions are given same symbols and their repeated explanation is omitted.

Figure 1:
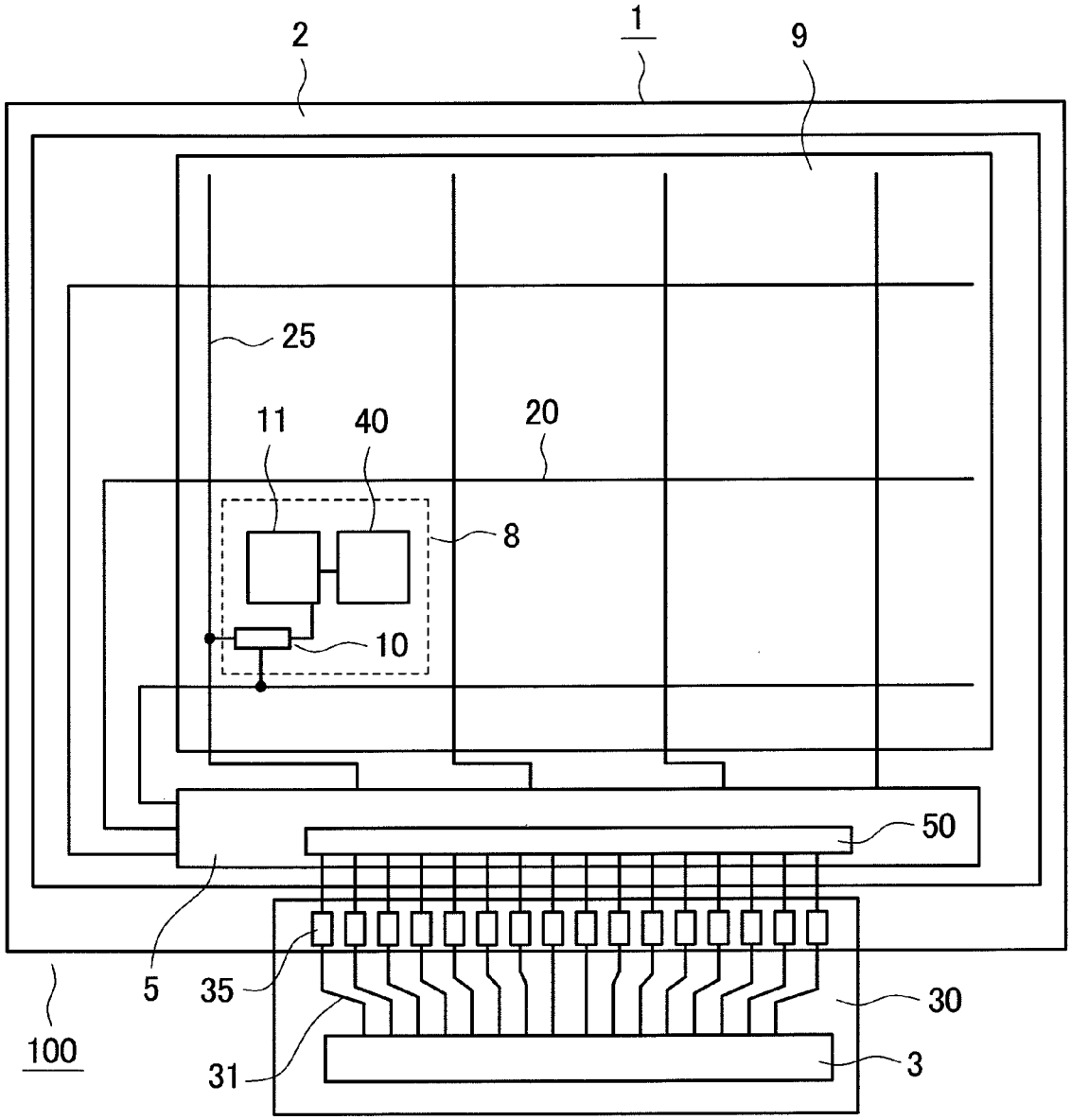
FIG. 1 is a schematic block diagram showing a display device of an embodiment of the present invention.

FIG. 1 is a block diagram showing the basic constitution of a display device of the embodiment of the present invention. As shown in the drawing, a display device 100 is constituted of a display panel 1 and a control circuit 3.

The display panel 1 includes an insulation substrate made of transparent glass, plastic or the like and an element substrate 2 which is formed of a semiconductor substrate. On the element substrate 2, pixels 8 are formed in a matrix array thus forming a display region 9 (In FIG. 1, to prevent the drawing from becoming complicated, one pixel is described and other pixels are omitted). The pixel 8 includes a pixel electrode 11, a switching element 10, and a memory element 40.

Around the display region 9, a drive circuit part 5 is formed along an end side of the element substrate 2. The drive circuit part 5 is formed on the element substrate 2 in steps similar to steps for forming the switching elements 10.

Scanning signal lines 20 extend to a display region from the drive circuit part 5, and the scanning signal lines 20 are electrically connected with control terminals of the switching elements 10. Then, the drive circuit part 5 outputs control signals (also referred to as scanning signals) to turn on and off the switching elements 10 to the scanning signal line 20.

Further, video signal lines 25 extend to a display region 9 from the drive circuit part 5, and the video signal lines 25 are connected to input terminals of the switching elements 10. Video signals are outputted to the video signal lines 25 from the drive circuit part 5, and the video signals are written in the pixel electrodes 11 via the switching elements 10 which are set to an ON state in response to the scanning signals.

A flexible substrate 30 is connected to the display panel 1, while the control circuit 3 is mounted on the flexible substrate 30. The control circuit 3 has a function of controlling a drive circuit formed in the drive circuit part 5 and supplies control signals, video signals and the like to the display panel 1 via the flexible substrate 30.

Display-use lines 31 are provided to the flexible printed circuit board 30, and the display-use lines 31 are electrically connected to the display panel 1 via input terminals 35. Signals which control the display panel 1 are supplied from the control circuit 3 via the display-use lines 31.

A level shift circuit 50 is provided to the drive circuit part 5 for converting voltage levels of video signals and the control signals inputted from the control circuit 3.

Figure 2:
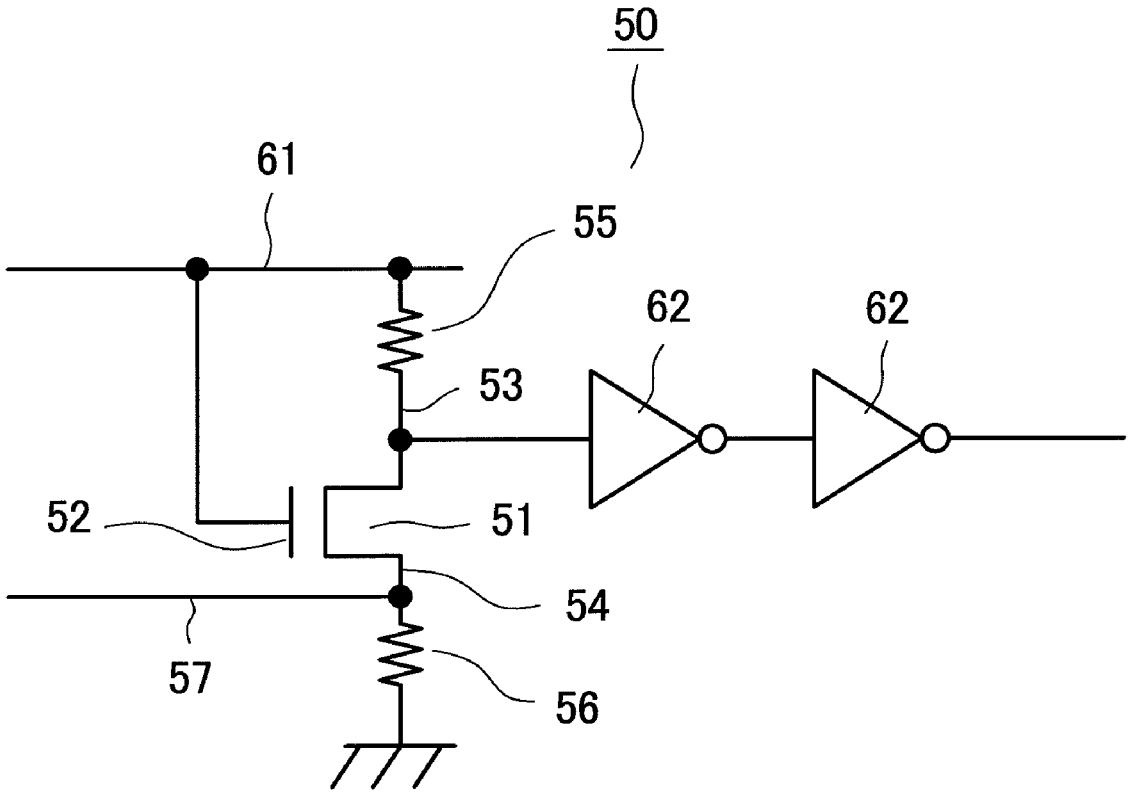
FIG. 2 is a schematic circuit diagram showing a level shift circuit of the embodiment of the present invention.

Next, the level shift circuit 50 is explained in conjunction with FIG. 2. The level shift circuit 50 is constituted of a transistor 51 and inverters 62. Although an n-type transistor is indicated as the transistor 51 shown in FIG. 2, it is possible to form a similar level shift circuit 50 using a p-type transistor by inverting the polarity of the transistor.

A drain resistance 55 is connected to a drain terminal 53 of the transistor 51, and a power source voltage Vdd is supplied to the drain terminal 53 from a power source line 61 via the drain resistance 55. Here, a resistance value of the drain resistance 55 is indicated by Rd.

A voltage equal to or more than a threshold value Vth of the transistor 51 is supplied to the gate terminal 52 of the transistor 51 so that the transistor 51 assumes an ON state. In FIG. 2, the transistor 51 is formed of the n-type transistor and hence, the power source voltage Vdd is applied to the gate terminal 52.

A source resistance 56 is connected to the source terminal 54 of the transistor 51. One end portion of the source resistance is connected to the ground potential. Further, an input terminal 57 is connected to the source terminal 54, and an input signal is inputted to the source terminal 54.

The inverter circuits 62 are connected to the drain terminal 53 in two stages thus performing the power amplification of an output of the transistor 51.

As mentioned previously, the transistor 51 assumes an ON state and a current flows in the transistor 51. Assuming a current which flows in the drain terminal 53 as Id, a voltage of the drain terminal 53 is expressed by a $Vdd-(Rd\times Id)$.

When a signal which is inputted to the input terminal 57 is at a low voltage level, by setting the relationship $Vdd-(Rd\times Id)<Vth$, a voltage which is equal to or less than the threshold value Vth is outputted from the drain terminal 53.

Next, when an input signal having a voltage at a high level is inputted to the input terminal 57, even when the high voltage level of the input signal is equal to or less than the threshold value Vth, due to the elevation of the voltage of the source terminal 54, a current which flows in the transistor 51 is decreased and hence, the drain current is decreased.

Here, by forming the drain resistance 55 such that the resistance value Rd satisfies the relationship $Vdd-(Rd\times Id')>Vth$, a voltage equal to or more than the threshold value Vth of the transistor which constitutes the inverter circuit 62 or the drive circuit part 5 which incorporates the inverter circuit 62 therein is outputted from the drain terminal 53. Id' is the drain current which is decreased.

With the use of the level shift circuit 50 shown in FIG. 2, even when the input signal having voltage of high level which is lower than the threshold value Vth of the internal circuit is inputted, it is possible to convert the voltage level to a value which allows the driving of the internal circuit.

Further, even in case of the control device 3 of low-voltage output, by realizing the provision of the level shift circuit 50 on the display panel 1 side, it is unnecessary to prepare the output circuit and the level shift circuit in conformity with the display panel 1 on the control circuit 3 side and hence, the flexibility in designing circuits can be enhanced.

However, in the level shift circuit 50 described in FIG. 2, operation points of the circuit are determined based on the value of the drain resistance 55. In the poly-silicon transistor, the threshold value Vth is high and the irregularities of the threshold value Vth are large and hence, there may be a case in which the output voltage maintains the high voltage level even when the input signal is at the low voltage level due to the current which flows in the transistor. On the other hand, even when the input signal assumes the high voltage level, the output voltage is not elevated to the high voltage level and is held at the low voltage level.

This operation is brought about due to the operation points of the level shift circuit 50, wherein when the input signal assumes the low voltage level and the output signal assumes the high voltage level, it is possible to overcome the drawback by increasing a voltage lowering mount with the increase of the drain resistance 55 thus dropping the output voltage to the low level.

Further, when the threshold value of the transistor 51 is changed so that the input signal assumes the high voltage level and the output signal assumes the low voltage level, the output voltage can be increased to the high voltage level by decreasing the drain resistance 55.

By adjusting the value of the drain resistance 55 in this manner, it is possible to overcome the drawback attributed to the irregularities of the threshold value Vth. However, it is difficult to adjust the drain resistance 55 for each one of a large number of level shift circuits.

Figure 3:
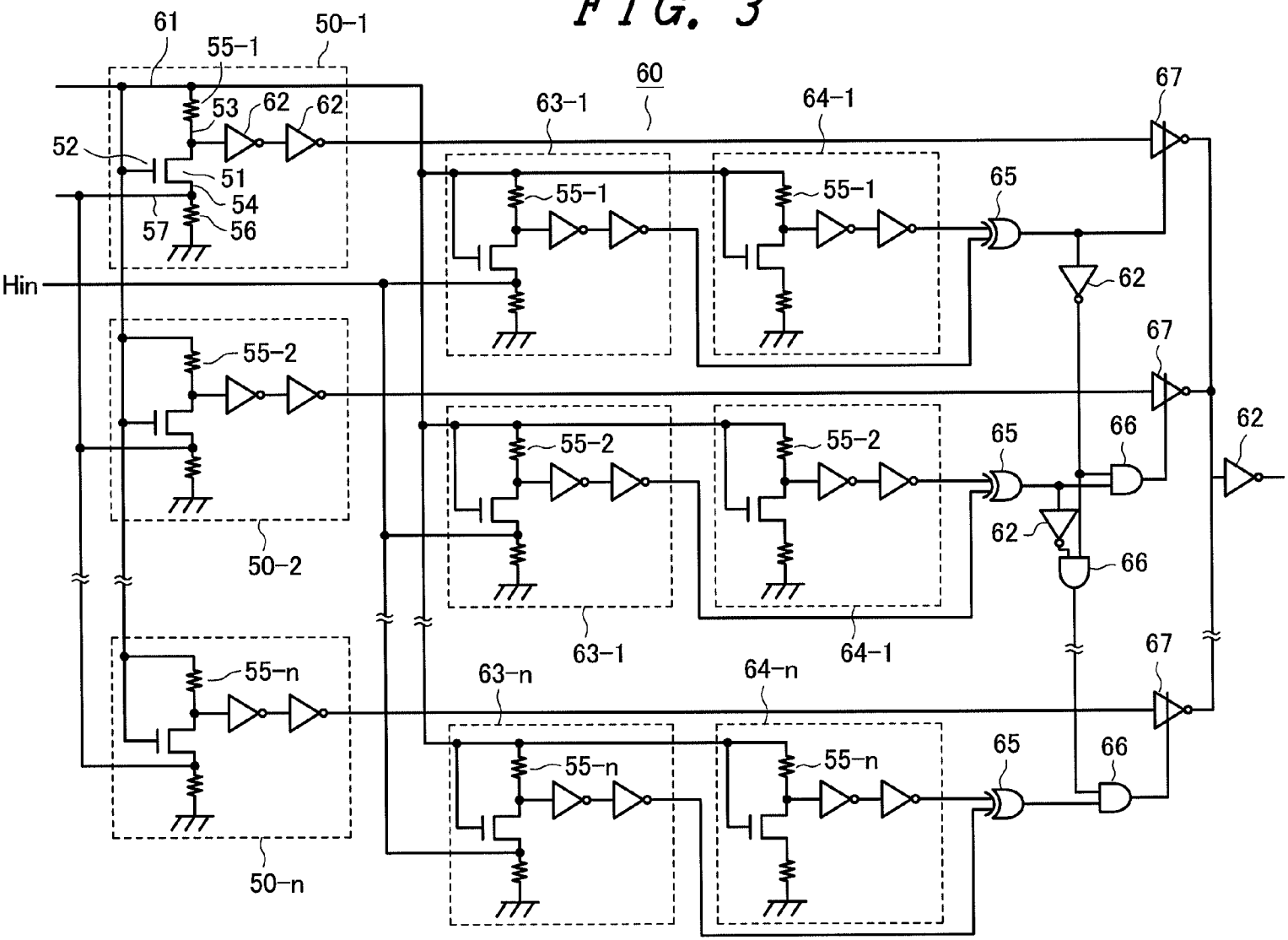
FIG. 3 is a schematic circuit diagram showing a level shift circuit of the embodiment of the present invention.

Accordingly, this embodiment adopts a circuit which can cope with the irregularities of the threshold value Vth as in the case of a circuit shown in FIG. 3.

FIG. 3 shows the circuit which includes a plurality of (n pieces of) level shift circuits 50 which differ from each other in the resistance value of the drain resistance 55 for one input signal.

The level shift circuit 50-1 includes a drain resistance 55-1, the level shift circuit 50-2 includes a drain resistance 55-2, and the level shift circuit **50-*n* includes the drain resistance 55-*n***.

n pieces of level shift circuits 50 include the drain resistances 55 which differ in the resistance value and hence, an input signal is inputted to the level shift circuits which have n pieces of operation points.

The level shift circuit 63 has the constitution similar to the constitution of the level shift circuit 50 although the level shift circuit 63 differs from the level shift circuit 50 with respect to a point that the high voltage level Hin of the input signal is applied to the source terminal 54. In the level shift circuit 63, the high voltage level Hin of the input signal is applied to the source terminal 54 and hence, the output voltage is outputted with the high voltage level, the output voltage generated by the drain resistance 55 which does not exceed the threshold value assumes the voltage of low level.

That is, the level shift circuit 63 which has the drain resistance 55 having the operation point which does not exceed the threshold value due to the irregularities of the threshold value or the like outputs the voltage of low level. Accordingly, the level shift circuit 63 with the defective operation outputs the voltage of low level and the level shift circuit 63 with the favorable operation outputs the voltage of high level.

In the same manner, the low voltage level Lin of the input signal is applied to the source terminal 54 of the level shift circuit 64. Accordingly, the level shift circuit 64 which has the drain resistance 55 having the operation point which exceeds the threshold value due to the irregularities of the threshold value or the like outputs the voltage of high level. Accordingly, the level shift circuit 64 with the defective operation outputs the voltage of high level and the level shift circuit 64 with the favorable operation outputs the voltage of low level.

Since the level shift circuit 63 with the favorable operation outputs the voltage of high level and the level shift circuit 64 with the favorable operation outputs the voltage of low level, by calculating respective outputs by an exclusive-OR circuit 65, it is possible to select the level shift circuit having the favorable operation point with the input signals having the voltage of low level and the voltage of high level.

By setting the drain resistances 55 of the level shift circuit 50 and the level shift circuits 63, 64 to the same value and by forming these circuits at positions close to each other on the substrate thus arranging the characteristics of the respective level shift circuits, it is possible to select the level shift circuit 50 which is correctively operated out of the level shift circuits 50 and to take out the output of the level shift circuit 50.

In FIG. 3, the selection is performed by calculating the output of the exclusive-OR circuit 65 and an inverted output of the exclusive-OR circuit 65 on an upper side using an AND circuit 66.

Since the upper-side output is inverted, when the value of the drain resistance 55 is decreased toward the lower side from the upper side, the level shift circuits 63, 64 initially select the level shift circuit 50 which has the drain resistance 55 providing the favorable operation.

Here, numeral 67 indicates a clock inverter, and is operated as an inverter when the input from the output side of the AND circuit 66 is at the high voltage level and becomes a high impedance when the input from the output side of the AND circuit 66 is at the low voltage level.

Although n pieces of level shift circuits 50 are arranged in parallel in FIG. 3, it may be sufficient to set the number of the level shift circuits 50 to be arranged in parallel to 2 or 3 from a viewpoint of practical use. That is, when the number of level shift circuits 50 is set such that n=3, there is provided the circuit having three operation points which includes a predetermined operational region, a case in which the operation point is displaced to the upper side, and a case in which the operation point is displaced to a lower side.

Figure 4:
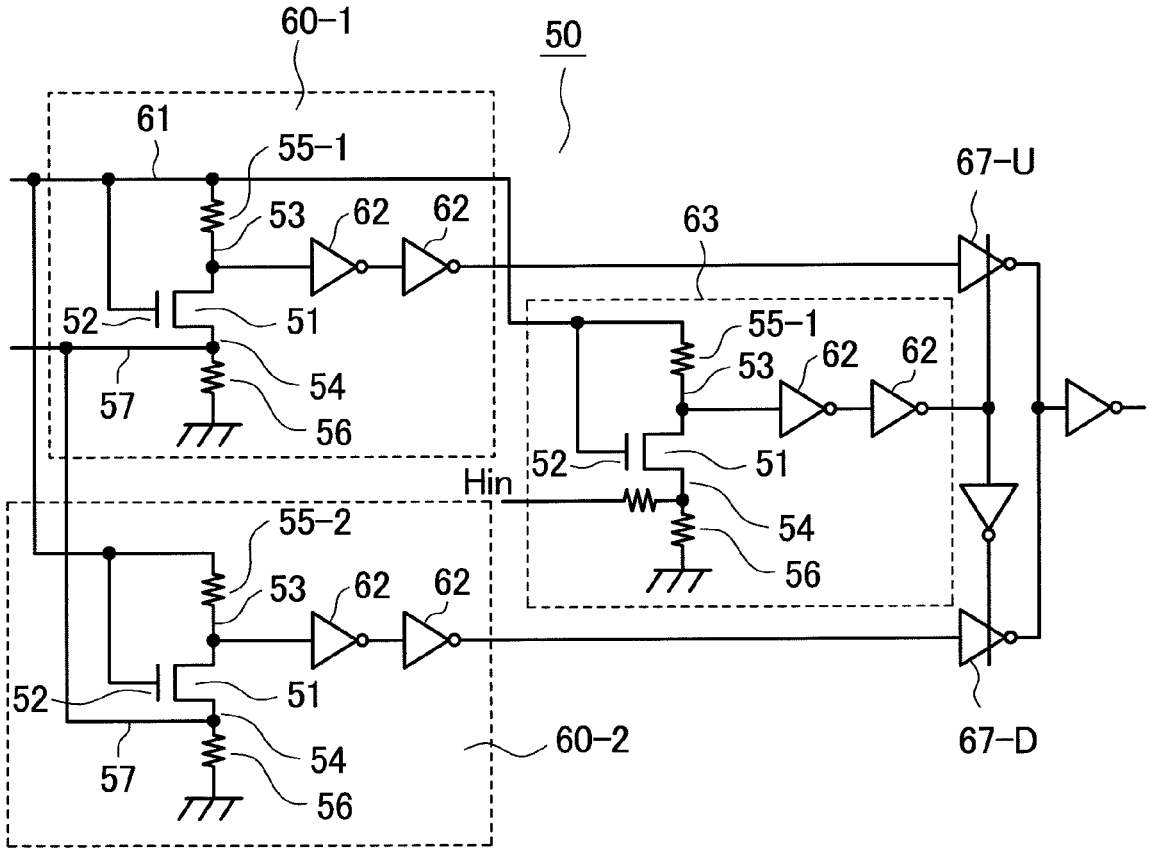
FIG. 4 is a schematic circuit diagram showing a level shift circuit of the embodiment of the present invention.

Further, when the number of the level shift circuit 50 is set such that n=2, the circuit is divided into a counter measure circuit for the case in which the threshold value is displaced to the upper side and the countermeasure circuit in which the threshold value is displaced to the lower side. FIG. 4 shows the countermeasure circuit when the threshold value is displaced to the low voltage side.

The high-level voltage of the input signal is applied to the source terminal 54 of the level shift circuit 63 in FIG. 4. The drain resistance 55-1 is connected to the level shift circuit 60-1 and the level shift circuit 63. Further, the drain resistance 55-2 which is connected to the level shift circuit 60-2 is set to a value smaller than the drain resistance 55-1.

When the level shift circuit 63 to which the drain resistance 55-1 is connected is normally operated with the high-level voltage of the input signal, the level shift circuit 63 outputs the voltage of high level and hence, the level shift circuit 60-1 is selected by a clocked inverter 67-U.

When the threshold value of the transistor 51 is changed to the low voltage side, the current which flows in the transistor 51 is increased. Accordingly, a voltage drop in the drain resistance 55-1 is increased and the level shift circuit 63 outputs the voltage of low level and hence, the level shift circuit 60-2 is selected by the clocked inverter 67-D.

In the level shift circuit 60-2, the drain resistance 55-2 is small and the operation point is set at a high value and hence, the voltage drop in the drain resistance 55-2 is small whereby even when the threshold value of the transistor 51 is changed to the low voltage side, it is possible to output the voltage of high level.

Figure 5:
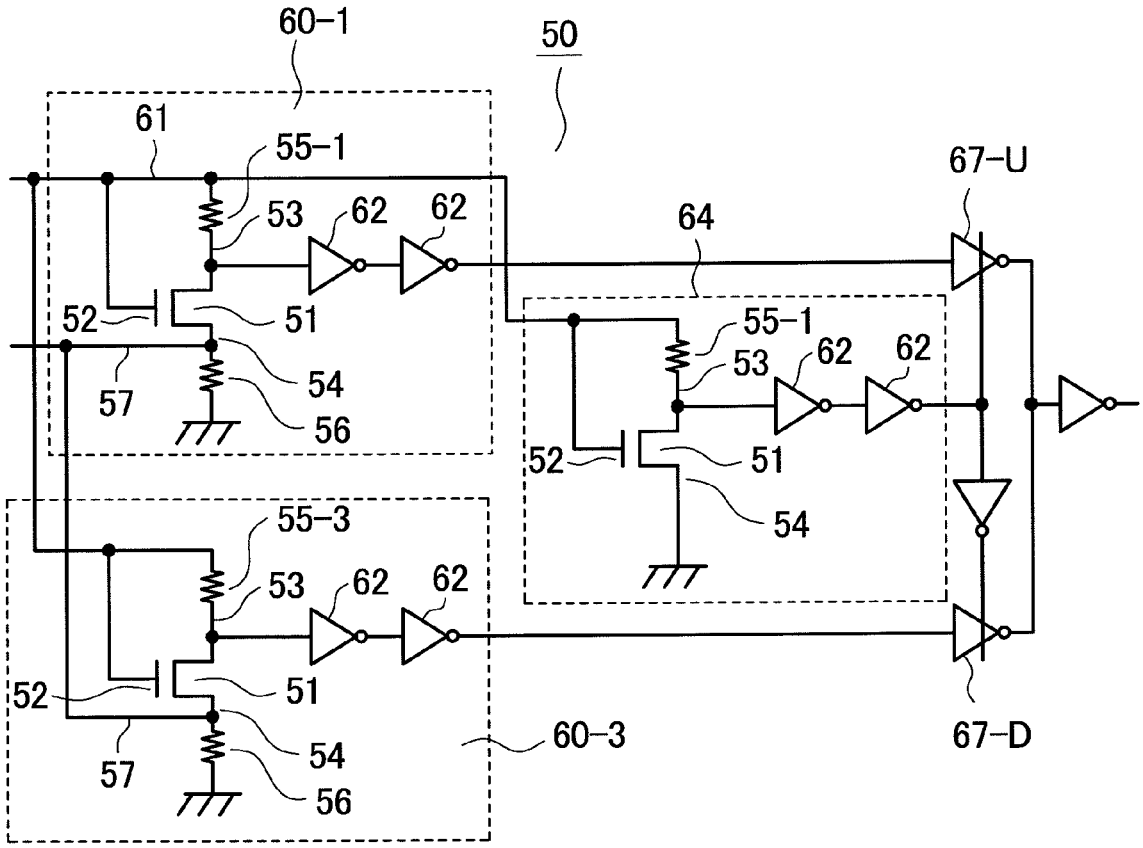
FIG. 5 is a schematic circuit diagram showing a level shift circuit of the embodiment of the present invention.

Next, a countermeasure circuit which can cope with the case in which the threshold value is displaced to the high-voltage side is shown in FIG. 5. An input signal having the voltage of low level is applied to the source terminal 54 of the level shift circuit 64 shown in FIG. 5. The drain resistance 55-1 is connected to the level shift circuit 60-1 and the level shift circuit 64. Further, the drain resistance 55-3 which is connected to the level shift circuit 60-3 is set to a value larger than the drain resistance 55-1.

When the level shift circuit 63-1 to which the drain resistance 55-1 is connected is normally operated with the input signal having the voltage of low level, the level shift circuit 60-1 is selected.

When the threshold value is changed to the high voltage level side, the level shift circuit 60-3 in which the drain resistance 55-3 is set to a large value and the operation point is set low is selected.

With respect to the level shift circuit 50 shown in FIG. 2 to FIG. 5, the circuit which has a drawback such as the large threshold value, the fluctuation of the threshold value can realize the level shift circuit which is normally operated. However, as mentioned previously, since the transistor 51 is used in an ON state, there exists a drawback that the power consumption is increased.

Figure 6:
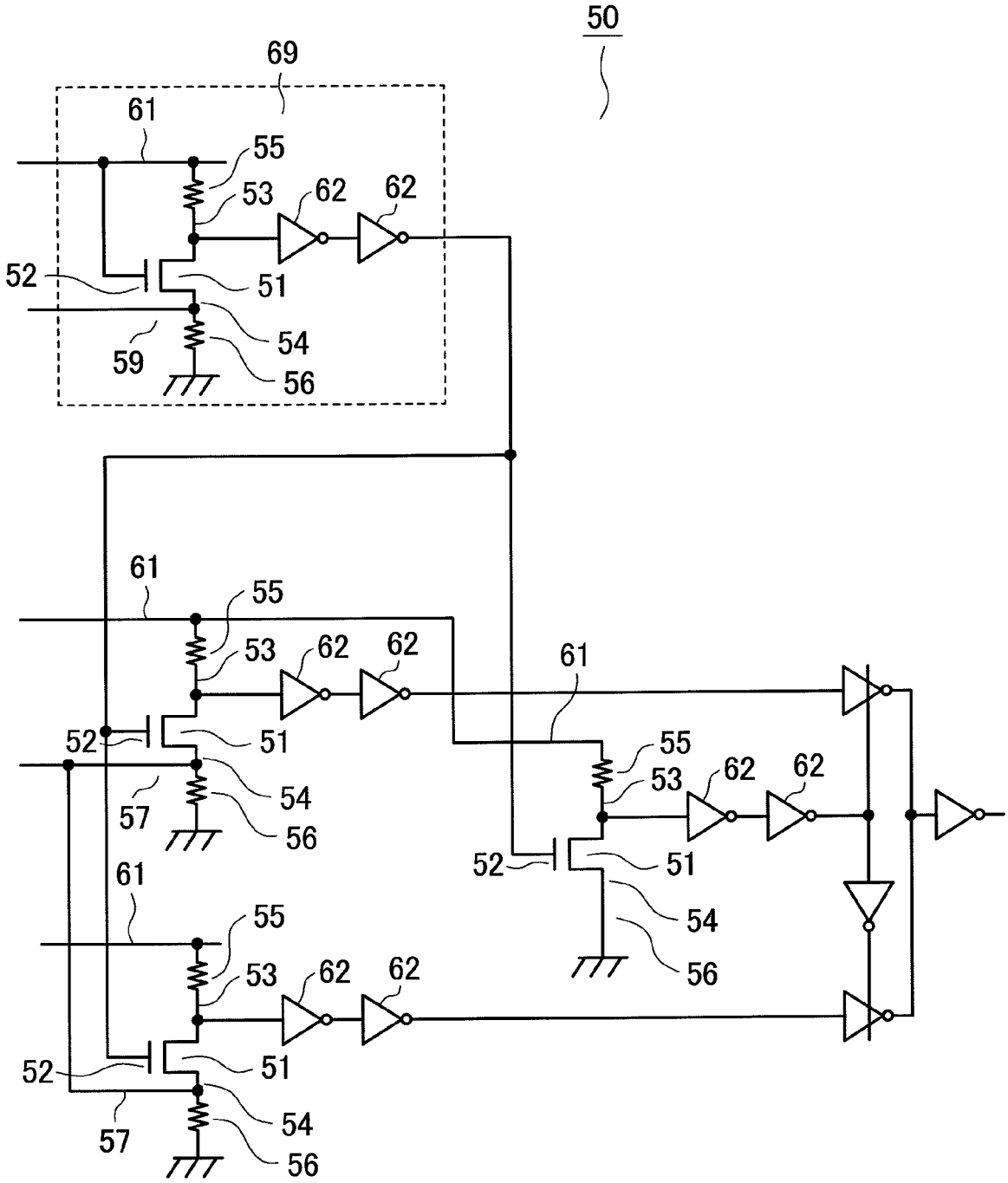
FIG. 6 is a schematic circuit diagram showing a level shift circuit of the embodiment of the present invention.

FIG. 6 shows a circuit which suppresses the power consumption. The circuit shown in FIG. 6 includes an enable circuit 69 and an enable terminal 59 and hence, the circuit brings the transistor 51 into an ON state when the circuit receives an enable signal from the outside.

By providing an enable input terminal which is connected to the enable terminal 59 to the input terminal 35 shown in FIG. 1, it is possible to bring the transistor 51 into an ON state in synchronism with inputting of the signal and hence, the power consumption can be suppressed.

According to this embodiment, even in the circuit which has the drawback such as the large threshold value and the fluctuation of the threshold value, it is possible to provide the level shift circuit corresponding to the low voltage input signal in the inside of the circuit.

What is claimed is:

1. A display device comprising:

a display panel;

a drive circuit which is formed on the display panel;

a plurality of first level shift circuits which are formed on the display panel;

at least one of second level shift circuits which are formed on the display panel; and at least one of selection circuits which are formed on the display panel, wherein:

the respective first level shift circuits and the respective second level shift circuits include a transistor, each of the first level shift circuits has a different value of a drain resistance, each of the second level shift circuits has a value of the drain resistance, the value of the drain resistance being equal to a value of the drain resistance of at least one of the first level shift circuits, a first input signal is inputted to a source terminal of the transistor of the respective first level shift circuits, the first input signal having a high voltage level and a low voltage level, a second input signal is inputted to the source terminal of the transistor of the respective second level shift circuits, the second input signal having a constant voltage which is the high voltage level or the low voltage level, each of the first level shift circuits and the second level shift circuits outputs an output voltage from the drain terminal of the transistor, and the at least one of the selection circuits selects a final output voltage which is determined by comparison of the output voltage of at least one of the second level shift circuits and the output voltage of the plurality of first level shift circuits respectively.

2. The display device according to claim 1, wherein at least one of the selection circuits selects the output voltage which is higher than a threshold value voltage of the transistor when the first input signal is the high voltage level.

3. The display device according to claim 1, wherein the display panel includes a plurality of pixels arranged in a matrix array, each pixel having a switching element coupled to receive a respective video signal, a pixel electrode connected to the switching element, and a memory element connected to the pixel electrode, and wherein the switch element of each pixel is turned ON/OFF in response to a respective scanning signal so as to write the respective video signal into the pixel electrode.

4. The display device according to claim 1, wherein the high voltage level of the first input signal is equal to or less than a threshold value voltage of the transistor.

5. The display device according to claim 1, wherein:

an ON voltage which is equal to or more than a threshold value voltage of the transistor is supplied to a gate terminal of the transistor, a power source voltage is applied to the drain terminal, via the drain resistance, the high voltage level of the first input signal is a lower voltage than a threshold value of the transistor, the output of each first level shift circuit is a lower voltage than the threshold value voltage which is obtained by a voltage drop of the power source voltage by a current flowing in the drain resistance when the first input signal is the low voltage level, and the output of each first level shift circuit is a higher voltage than the threshold value voltage which is obtained by decreasing the voltage drop in the drain resistance when the first input signal is the high voltage level.

6. The display device according to claim 1, wherein the transistor is formed of poly-silicon.

7. The display device according to claim 1, wherein the transistor is turned ON when an enable signal is inputted to the first level shift circuits and the second level shift circuits.

8. A display device comprising:

a display panel;

a drive circuit which is formed on the display panel;

a plurality of first level shift circuits which are formed on the display panel;

at least one of second level shift circuits which are formed on the display panel;

at least one of third level shift circuits which are formed on the display panel; and at least one of selection circuits which are formed on the display panel, wherein:

the respective first level shift circuits, the respective second level shift circuits and the respective third level shift circuits include a transistor, a drain resistance is connected to a drain terminal of the transistor, each of the first level shift circuits has a different value of the drain resistance each other, each of the second level shift circuits has a value of the drain resistance, the value of the drain resistance being equal to a value of the drain resistance of at least one of the first level shift circuits, each of the third level shift circuits has a value of the drain resistance, the value of the drain resistance being equal to a value of the drain resistance of at least one of the first level shift circuits, a first input signal is inputted to a source terminal of the transistor of the respective first level shift circuits, the first input signal having a high voltage level and a low voltage level, a second input signal is inputted to a source terminal of the transistor of the respective second level shift circuits, the second input signal having a constant voltage which is the high voltage level, a third input signal is inputted to a source terminal of the transistor of the respective third level shift circuits, the third input signal having a constant voltage which is the low voltage level, each of the first level shift circuits, the second level shift circuits, and the third level shift circuits outputs an output voltage from the drain terminal of the transistor, and the at least one of the selection circuits selects a final output voltage which is outputted by one of the plurality of first level shift circuits, the final output voltage being determined by comparison with the output voltage of at least one of the second level shift circuits and at least one of the third level shift circuits.

9. The display device according to claim 8, wherein at least one of the selection circuits selects the output voltage which is higher than a threshold value voltage of the transistor when the first input signal is a high voltage level.

10. The display device according to claim 8, wherein the transistor is turned ON when an enable signal is inputted to the first level shift circuits, the second level shift circuits and the third level shift circuits.

* * * * *